United States Patent [19]

Meheen

[11] Patent Number: 4,707,962

[45] Date of Patent: Nov. 24, 1987

[54] CASCADE WALL STRUCTURE

[75] Inventor: H. Joe Meheen, Denver, Colo.

[73] Assignee: Meheen Engineering Corp., Denver, Colo.

[21] Appl. No.: 833,100

[22] Filed: Feb. 25, 1986

[51] Int. Cl.[4] ..... E04B 1/02

[52] U.S. Cl. ..... 52/565; 52/585; 405/273; 405/275

[58] Field of Search ..... 52/565, 299, 585; 405/262, 273, 275, 281, 284, 285, 286

[56] References Cited

U.S. PATENT DOCUMENTS

| | | | |
|---|---|---|---|
| 1,460,263 | 6/1923 | Ver Mehr | 405/281 |
| 1,847,655 | 3/1932 | Knight | 405/275 |
| 1,907,053 | 5/1933 | Flath | 405/273 |
| 3,820,343 | 6/1974 | Morren | 405/286 |
| 4,050,254 | 9/1977 | Meheen et al. . | |
| 4,207,718 | 6/1980 | Schaaf et al. | 52/585 |

FOREIGN PATENT DOCUMENTS

| | | | |
|---|---|---|---|
| 277078 | 12/1969 | Austria | 405/273 |
| 812463 | 7/1949 | Fed. Rep. of Germany | 405/285 |

*Primary Examiner*—William F. Pate, III
*Assistant Examiner*—Creighton Smith
*Attorney, Agent, or Firm*—Fields, Lewis, Pittenger & Rost

[57] ABSTRACT

A cascade wall structure is provided which is made up of two elements, namely, a generally rectangular member with end ribs and a curved panel having curved ends which interlock with curved surfaces on the ribs of the members for creating a variety of wall structures for different purposes and different uses. In one wall structure the ribbed members are spaced in spaced parallel relationship with the curved panels interconnecting them. In another embodiment, the ribbed panel members are spaced in spaced parallel relationship and curved members interconnect them from a forward end to a rear end, respectively. Because of the angular and curved surfaces of the wall structure, it can serve as an effective sound barrier by deflecting the sound upwardly and against the multiple surfaces of the wall to dissipate the same. In addition, the wall can be backfilled with dirt to provide additional sound deadening and strength.

5 Claims, 7 Drawing Figures

CASCADE WALL STRUCTURE

TECHNICAL FIELD

This invention relates to a cascade wall structure, and more particularly to a cascade wall structure having wall section elements that can be interconnected in a variety of ways to provide a structure which can take several forms and which can serve as a fence, a retaining wall or as a sound barrier and may be constructed in alternative arrangements for other different purposes.

BACKGROUND ART

Various types of modular structures have been devised which are capable of serving as a retaining wall. One such modular retaining wall is shown in applicant's U.S. Pat. No. 4,050,254, entitled "Modular Structures, Retaining Wall System, and Method of Construction". The wall is made up of a series of spaced tie-back elements which extend back into the earth and support panels between them and behind which dirt is packed. Retaining walls constructed in this fashion may be terraced, if desired. The modular construction just described works very well for its intended purposes. However, it is made of large cumbersome elements and is not readily adapted for other uses, such as a sound barrier or a privacy wall.

Another form of modular retaining wall is shown in my U.S. patent application Ser. No. 738,642, filed May 28, 1985 for "Retaining Wall with Tie-Back Elements". The modular elements of this wall are of smaller size than those shown in applicant's earlier patent and are quite suitable for terraces and gardens but do not have extensive versatility for forming sound barriers and for other uses as discussed below.

DISCLOSURE OF THE INVENTION

In accordance with this invention a structural wall member is provided for use in constructing a cascade wall. The wall member comprises a planar body portion having a generally rectangular configuration which includes an upper edge, a lower edge, and opposite ends. An enlarged rib is formed along each opposite edge with each rib joining each end along a radial surface which serves as an abutment for an intermediate curved wall panel section for interconnecting the wall members. A longitudinal passageway is provided through each rib through which anchoring means can extend to secure the member in fixed position relative to the ground. The wall structure also includes an intermediate panel having upper and lower spaced parallel edges and opposite parallel ends, each panel having a curved edge portion which nests in the radial portion of the adjacent wall members ribs to form an integral wall structure. The wall members are generally planar and the panels are generally curved. The members and the panels are alternated for the length of the wall. The members and the panels can be stacked in multiple rows so that the longitudinal passageways of each stack are aligned and an anchoring rod can extend through each set of aligned passageways and be secured in the ground to hold the wall in fixed position.

In one embodiment, one end of the panel engages the member to create a wall having a zigzag configuration.

In another embodiment, the members are arranged in parallel spaced pairs with a pair of the curved panels positioned to curve toward each other and having their curved end portions engaging the radial portions of corresponding ribs of the spaced members to form a quadrangular configuration. Dirt can be placed within the quadrangle configuration to form a more sturdy wall and a sound barrier.

A sound barrier construction can be provided wherein a first plurality of longitudinal retaining walls are arranged in cascade or stair-step fashion so that the barrier is wider at the bottom than at the top. Each wall comprises a plurality of curved sound deflecting panels for deflecting sound away from the sound producing source. Means interconnect the panels and anchor them in place and earth is backfilled behind the rows of panels. If desired, a second plurality of longitudinal retaining walls can be arranged in stair-step fashion back-to-back with the first plurality of walls to form a stepped pyramid construction in cross section which is filled with earth therebetween. The sound barrier can be arranged in a horseshoe shaped configuration for deflecting and dissipating sound from a sound producing source placed within the confines of the barrier. With this arrangement, the panels and the interconnecting means deflect a substantial portion of the sound upwardly. Geofabric can be used in conjunction with the wall structure to minimize shifting of the dirt adjacent the wall.

From the foregoing, the advantages of this invention are readily apparent. A very versatile wall structure which can be constructed in several configurations and which can be used for privacy or as a sound barrier or as walls of a shelter is provided. The elements which make up the wall are relatively low cost and can be made of cast concrete or corrugated metal or molded plastic. Additional advantages of this invention will become apparent from the description which follows, taken in conjunction with the accompanying drawings.

BEST MODE OF CARRYING OUT THE INVENTION

Figure 1:
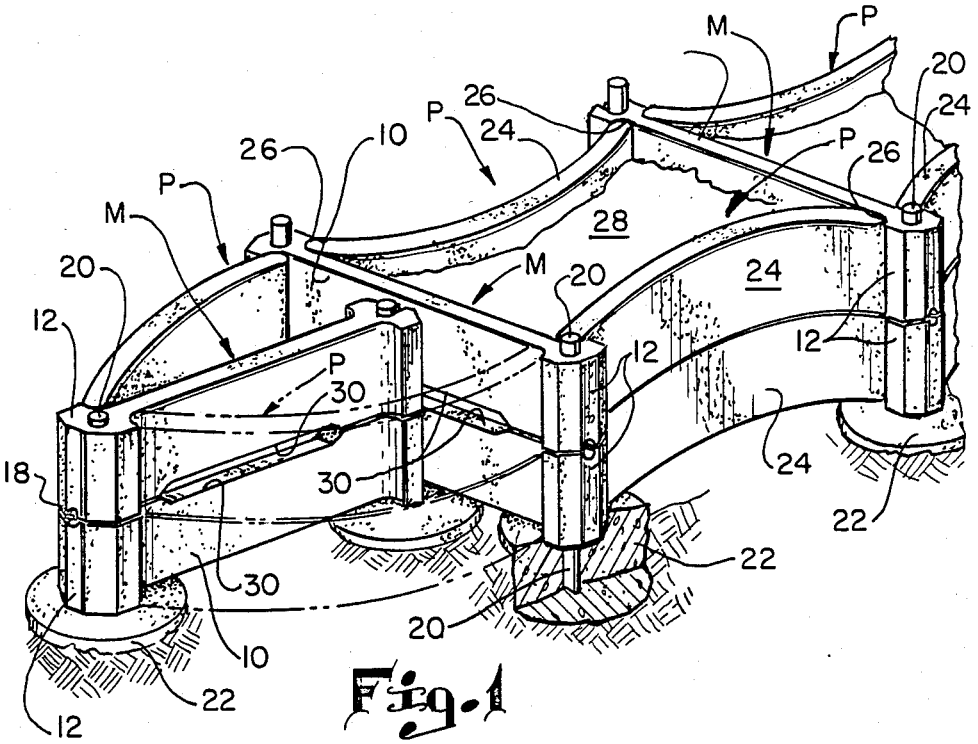
FIG. 1 is a fragmentary perspective view, with portions shown in phantom for clarity of illustration, of quadrangular wall constructed in accordance with this invention.
Figure 2:
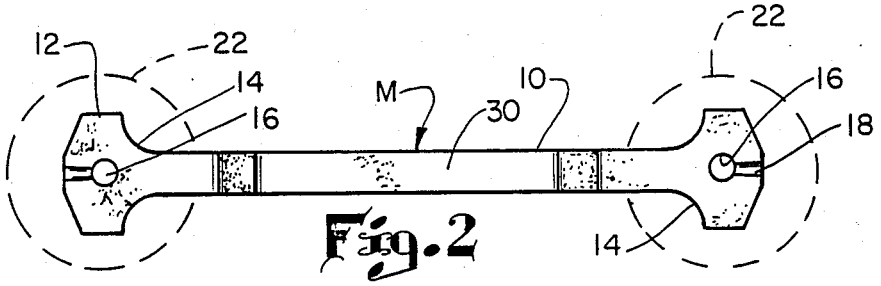
FIG. 2 is an enlarged top plan view of one of the wall members.
Figure 3:
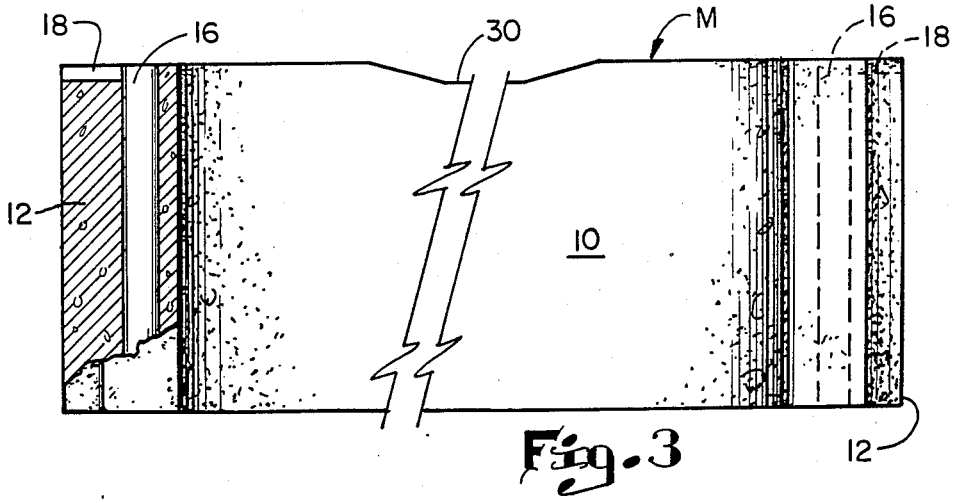
FIG. 3 is an enlarged, fragmentary, side elevation of the wall member shown in FIG. 2, with parts broken away for clarity of illustration.

In accordance with this invention a first embodiment of a wall structure shown in FIG. 1 wherein the wall is made up of a series of I-shaped members M having a web in the form of a planar body portion 10 terminating in enlarged ends or ribs 12. Conveniently, this panel may be formed from cast concrete which may have suitable reinforcing material (not shown) as is apparent to one skilled in the art. Each enlarged end 12 joins body portion 10 along a curved surface or cove 14. Each rib has a vertical passageway 16 therethrough. At one end of each passageway 16 is a lateral port 18 to allow any water or moisture that accumulates in passageway 16 to escape so that the ribs 12 will not be cracked due to water freezing in the passageway and expanding.

As will be apparent from viewing FIG. 1, the members 10 can be stacked vertically and permanently secured in the ground by means of vertical rods 20, such as reinforcing rods, which extend down into the ground as into caissons 22. In the arrangement shown in FIG. 1, the members M may be arranged in spaced parallel relationship and stacked as high as the stress limits of the construction of material will permit. The spacing is such as to receive the ends of curved panels P each of which has a generally rectangular body portion 24 having curved ends 26 which are received in curved surfaces or coves 14 of panels M, as shown. The panels F also can be cast from concrete and be reinforced, as needed. As will be apparent from the geometrical relationship of the parts, the wall sections will each have a quadrangular configuration wherein the elements are interlocked with respect to each other. Additional wall sections can be constructed so as to make a wall having the length desired. The interior of the quadrangular configuration can be filled with dirt 28 to strengthen the wall and to serve as a sound deadening material. Conveniently, at the end of the wall, the elements can be rearranged to create an attractive and structurally useful end construction. In this regard, the last set of members M can be placed at right angles and intermediate the previous set of members M, as shown in FIG. 1, and anchored in place by means of anchoring rods 20 so as to hold the last parallel set of members M against lateral displacement. The panels P can then be placed between the outer ends of the last set of parallel members and the outer ends of the perpendicular members as shown, one set of panels P being shown in phantom for clarity of illustration.

Conveniently, a recess 30 can be provided along one edge of panel 10, as shown. When stacking, the members M can be arranged so that two recesses 30 face each other to provide an opening therebetween through which conduits, which carry electrical wires for lighting or tubing for irrigation purposes can be provided.

Figure 4:
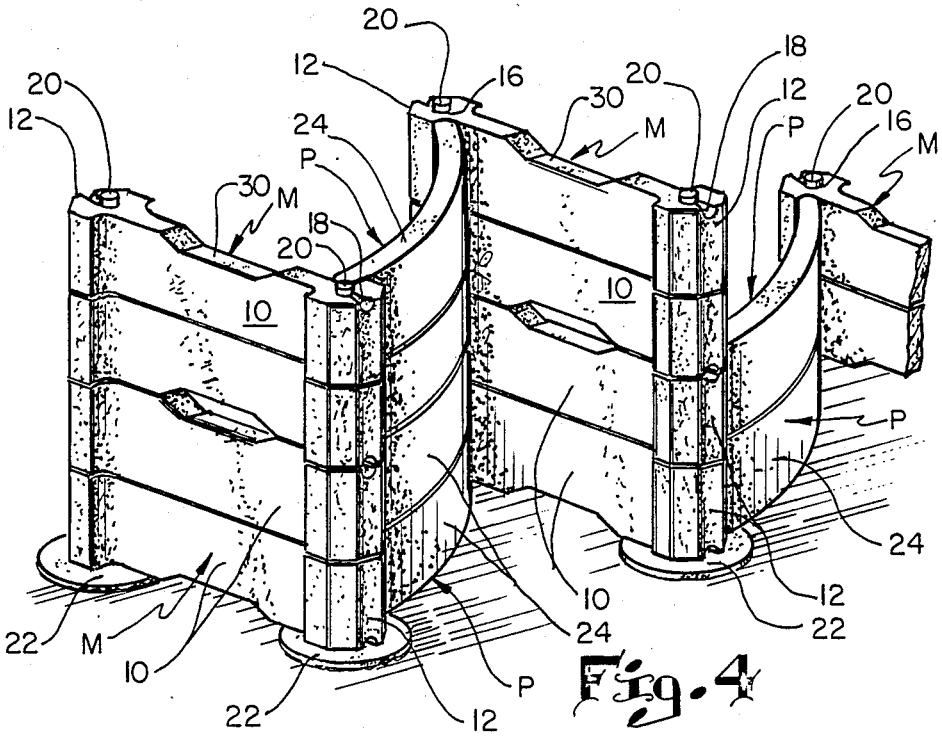
FIG. 4 is a fragmentary perspective view, similar to FIG. 1, but showing an alternative zigzag wall construction using the same elements as the wall in FIG. 1.

An alternative arrangement is shown in FIG. 4 wherein the members M and panels P are alternated and the panels extend from the forward end of one member to the rear end of the next member to provide a zigzag arrangement. This structure can be built up vertically as a plurality of panels to any suitable height. Such a fence can be used for privacy or it can be used as a terrace or as a sound barrier. Also, it has use along the sides of a stream bed to help define the channel and to provide an irregular flow of water so that the water is aerated as it passes around the edges of the wall.

Figure 5:
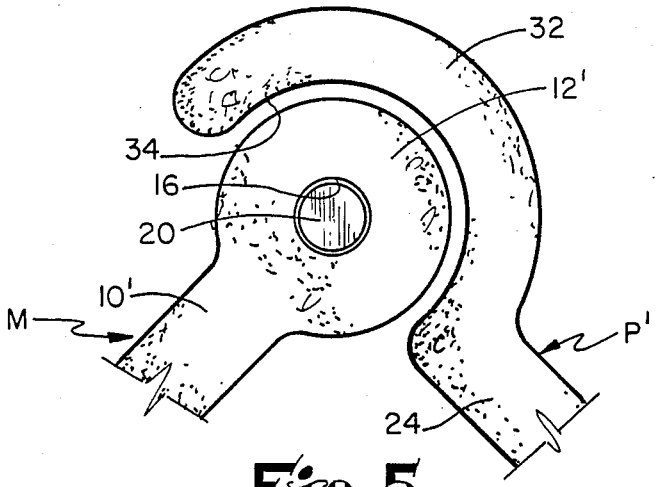
FIG. 5 is a fragmentary, enlarged, top plan view of an alternative end structure for the wall members and panels when used in the zigzag configuration of FIG. 4.

An alternative end structure for both the member M and panel P is shown in FIG. 5. In this construction, a panel M' has a planar body member 10' terminating in enlarged ends or ribs 12' which are circular in configuration and have a central passageway 16' for receiving a reinforcing rod 20. Panel P' has a body 24' which terminates in a curved end 32 having a recess or groove 34 for receiving the surface of rib 12'. It will be understood that the member and panel may be pivoted to some extent with respect to each other so as to vary the angularity of the constructed wall.

Although the wall members and panels have been shown and described as being made from cast concrete, it will be understood that other suitable materials can be used. By way of example, the body of the members and panels can be made of corrugated steel. The ends of the members can be formed from sheet metal welded to the corrugated body.

Figure 6:
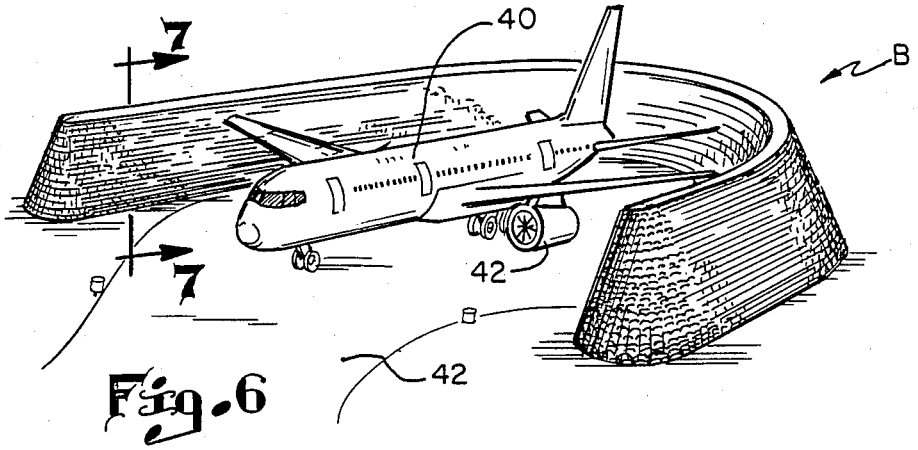
FIG. 6 is a perspective view of a sound barrier wall constructed in accordance with this invention.
Figure 7:
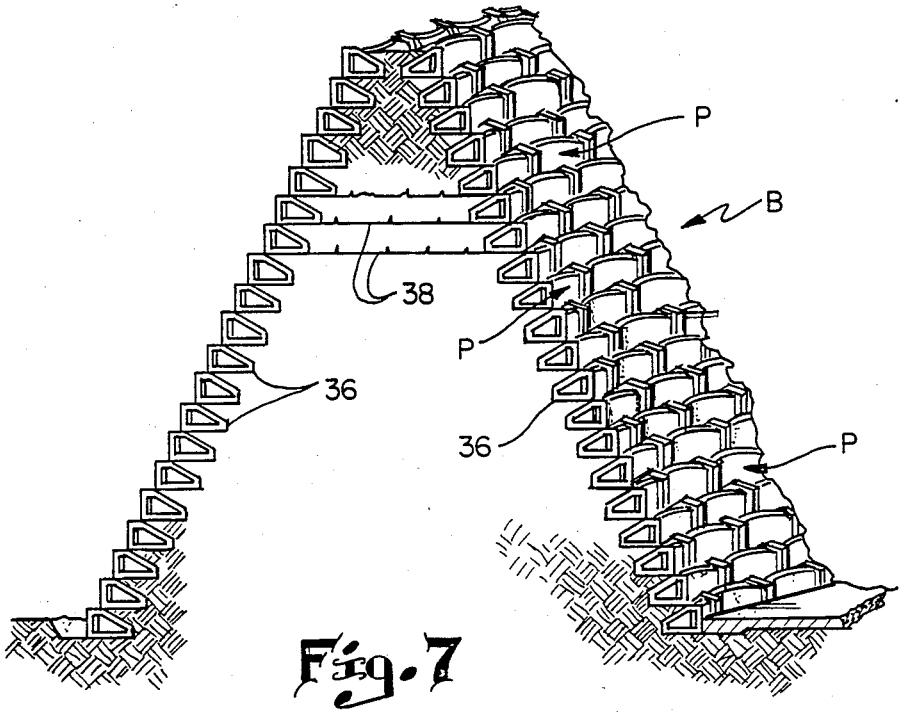
FIG. 7 is a greatly enlarged vertical section, taken along 7—7 of FIG. 6.

A particular form of sound barrier B is shown in FIGS. 6 and 7. It is constructed in a pyramidal configuration and is made up of curved panels P interconnected by tie-backs 36 which can be of any suitable figuration but are illustrated as having a generally D-shaped configuration. They can have other configurations also, such as that shown in FIG. 1 or FIG. 4. The space between the two sides of the pyramid is filled with dirt during construction for sound deadening. If desired, geofabric 38 can be extended back from each wall section to more effectively hold the dirt in place. It will be understood that the geofabric could be used in any cascade wall and is not limited to use in the sound barrier. By arranging the sound barrier in a generally U-shaped configuration, as shown in FIG. 5, it can be used for testing high level noise producing devices without disturbing persons in the vicinity of the test. As illustrated, an airplane 40 having jet engines 42 can have those engines tested by being positioned within the bunker or sound barrier B, as illustrated. This barrier B can be arranged in a horseshoe shaped configuration around a taxiway 42 along which the airplane can be moved into and out of the sound barrier. The irregularity of the cascade wall will cause the sound to be bounced back and forth off of the wall surfaces and be absorbed and to be reflected upwardly away from those who would otherwise be disturbed by the sound.

From the foregoing, it can be seen that the cascade wall structure of this invention can be used for a variety of purposes while being eoonomical in construction. It can be used for terracing, gardening, agriculture, wildlife habitat, erosion control, etc. The wall, as constructed in accordance with either embodiment of the invention, can be used to support landscaping and vegetation. It can be used in stadiums and amphitheaters and as sound barriers for highways and airports and in industrial plants. It can also be used for bunkers and mine tailing and for confinement of fill slopes with significant reduction in fill quantities necessary to restore the land to its previous condition. It can be used for providing insulated walls for earth houses without the need for a foundation. As previously mentioned, it can be used for trickle streams as well as for drainage draws. Vertical retaining walls can be achieved by the use of geofabrics or reinforcing elements. The unit cost of the wall remains constant regardless of its height whereas in a conventional retaining wall, the cost increases in proportion to its height. The cascade wall elements can be mass produced on an ordinary vibrated block machine thereby minimizing cost.

This invention has been described in detail with reference to a particular embodiment thereof, but it will be understood that various other modifications can be effected within the spirit and scope of this invention.

I claim:

1. A modular outdoor wall construction comprising:

at least a first pair of contiguous identical vertically stacked members wherein each of said members includes:

a planar body portion having a generally rectangular configuration having a height defined by spaced parallel upper and lower edges and which includes opposite ends;

an enlarged rib formed along each opposite end, each said rib joining each said end along a radial concave abutment surface means, each forming a cove;

aligned vertical passageways through each of said ribs of said stacked members;

an anchoring rod extending through said passageways for securing said stacked members in aligned contiguous relationship;

at least a second pair of contiguous identical vertical stacked intermediate panels wherein each of said intermediate panels includes;

a curved planar member having spaced upper and lower parallel edges defining a height substantially equal to the height of each of said first stacked members; and opposite parallel rounded ends which nest in said cove of said respective ribs of said stacked members in any one of a plurality of angular relationships with said vertically stacked members to form said wall construction.

2. A wall structure, as claimed in claim 1, wherein:

one rounded end of the panel engages said cove of said rib at one end of said members and the other rounded end of the panel engages said cove of said rib at the opposite end of the next of said members to form a wall havinga zigzag configuration.

3. A wall structure, as claimed in claim 2, wherein:

each of said panels are curved in the same direction.

4. A wall structure, as claimed in claim 1, wherein the wall includes a plurality of sections, each section including:

a pair of parallel spaced members;

a pair of curved panels positioned to curve toward each other and having their rounded ends engaging said curved abutment surface of said cove of corresponding ribs of said spaced member to form a quadrangular configuration.

5. A wall structure, as claimed in claim 4, further including an end section, said end section comprising:

one of said wall members being substantially perpendicular to and intermediate the ends of the last of said parallel spaced wall members; and an additional pair of curved panels positioned between the outwardly extending end of said perpendicular wall member and the opposite ends of said last parallel spaced member, each of said curved panels having their rounded ends engaging said curved abutment surface of said cove of said ribs of said respective wall members.

* * * * *